US008319431B2

(12) United States Patent
Boroczki et al.

(10) Patent No.: US 8,319,431 B2
(45) Date of Patent: Nov. 27, 2012

(54) CERAMIC ARC TUBE FOR A DISCHARGE LAMP AND METHOD OF MAKING SAME

(75) Inventors: Agoston Boroczki, Budapest (HU); Istvan Csanyi, Dunakeszi (HU); Christopher E. Omalley, Louisville, KY (US); Attila Agod, Berettyoujfalu (HU); Venkata Subbaiah Chennamshetty, Karnataka (IN); Shanmugam Venkatachalam Ravi, Karnataka (IN); Guy Henry Turner, Chicago, IL (US)

(73) Assignee: General Electric Company, Schenectady, NY (US)

( * ) Notice: Subject to any disclaimer, the term of this patent is extended or adjusted under 35 U.S.C. 154(b) by 121 days.

(21) Appl. No.: 12/823,360

(22) Filed: Jun. 25, 2010

(65) Prior Publication Data

US 2011/0316406 A1 Dec. 29, 2011

(51) Int. Cl.
*H01J 17/18* (2012.01)

(52) U.S. Cl. ..... 313/623; 313/624; 313/625

(58) Field of Classification Search ..... 313/623, 313/624, 625

See application file for complete search history.

(56) References Cited

U.S. PATENT DOCUMENTS

| | | | |
|---|---|---|---|
| 4,285,732 | A | 8/1981 | Charles et al. |
| 5,725,827 | A | 3/1998 | Rhodes et al. |
| 2007/0001611 | A1 | 1/2007 | Bewlay |

FOREIGN PATENT DOCUMENTS

| | | | |
|---|---|---|---|
| EP | 0186348 | A2 | 7/1986 |
| EP | 1755147 | A1 | 2/2007 |
| GB | 1465212 | A | 2/1977 |

OTHER PUBLICATIONS

PCT Invitation to pay additional fees issued in connection with corresponding WO Patent Application No. US 11/36718 filed on May 17, 2011.

*Primary Examiner* — Vip Patel
(74) *Attorney, Agent, or Firm* — Fay Sharpe LLP

(57) ABSTRACT

A High Intensity Discharge lamp and method of making same having an arc tube defining a discharge chamber with opposite ends of the tube each receiving an electrode extending into the discharge chamber and define an axial gap therebetween. A thermal shield extends from each opposite end of the arc tube and defines a radial gap with the tube. The thermal shields in some embodiments extend from end plugs in the arc tube; and, in another embodiment use formed, integrally with one arc tube sections and the tube sections joined.

23 Claims, 14 Drawing Sheets

CERAMIC ARC TUBE FOR A DISCHARGE LAMP AND METHOD OF MAKING SAME

BACKGROUND OF THE DISCLOSURE

The present disclosure relates to ceramic discharge arc tubes for a High Intensity Discharge (HID) lamp, such as a ceramic metal halide discharge lamp or a high pressure sodium discharge lamp and a method of making ceramic discharge arc tubes for such lamps.

Discharge lamps, such as ceramic metal halide discharge lamps, produce light by ionizing a fill such as a mixture of metal halides and mercury, or its alternative in mercury-free discharge lamps as a buffer/voltage riser material like mercury in mercury containing lamps, with an electric arc passing between two electrodes forming a discharge plasma due to ionization of the fill. The electrodes and the fill are sealed within a translucent or transparent discharge chamber which maintains the pressure of the energized fill material and allows the emitted light to pass through it. The fill, also known as "dose" emits a desired spectral energy distribution of visible electromagnetic radiation also called "light" in response to being excited by the electric arc.

The arc tube in a high intensity discharge lamp can be formed from a material such as fused silica also called "quartz glass" which is shaped into the desired discharge chamber geometry after being heated to a softened state. Fused silica, however, has certain disadvantages which arise from its reactive chemical as well as its thermodynamically unstable structural properties at high operating temperatures. For example, at temperatures greater than about 950° C. to 1000° C., the halide fill reacts with the quartz glass which process produces silicates and silicate halides, thus reducing the effective quantity of fill constituents. Elevated temperatures also cause sodium to permeate through the quartz wall. These fill depletion phenomena cause color shift over time which reduces the useful life of the lamp. Additionally, at high temperatures, transformation of fused silica from amorphous phase to crystalline phase ("re-crystallization") also occurs, which reduces the mechanical strength and optical transmission of the discharge chamber wall.

Ceramic discharge arc tubes were developed to operate at relatively higher temperatures for improved color control, color renderings and luminous properties while significantly reducing reactions of the discharge chamber wall with the fill material. For example, it is known to employ translucent polycrystalline alumina sintered bodies that enables visible wavelength radiation to pass through and makes the body useful for use as an arc tube for high pressure sodium and ceramic metal halide discharge lamps.

In certain applications where ceramic arc tube discharge lamps are employed in a horizontal disposition, as for example in automotive headlamp applications, the arc between the electrodes creating the plasma for producing light is configured in an upwardly arched profile which causes excessive temperatures on the upper wall surfaces of the arc tube. This extremely high "hot spot" temperature and the related temperature gradients developed within the discharge chamber wall leads to excessive thermally induced mechanical stresses in the arc tube assembly. Exposure to these excessive temperature and thermal stresses has heretofore resulted in reduced lamp reliability; and, in applications such as automotive, has resulted in premature lamp failure due to crack development and propagation within the arc tube assembly, costly replacement and attendant user dissatisfaction.

Thus, it has been desired to find a way or means for preventing excessive temperatures and thermal stresses in the ceramic arc tube assemblies of arc discharge lamps and particularly where such lamps are disposed with the arc tube in a horizontal arrangement such as found for example in case of automotive headlamp applications.

SUMMARY OF THE DISCLOSURE

The present disclosure describes a high intensity discharge lamp having a ceramic arc tube with a substantially tubular member at its center portion defining a discharge chamber between opposite ends of this central arc tube member with an opening provided in each of the opposite ends for receiving an electrode. A thermal shield extends from each of the opposite ends of the substantially tubular ceramic member inwardly of the discharge chamber and defines a radial gap with the wall of the substantially tubular ceramic member. An electrode is received in each of the opposite end openings and extends into the discharge chamber; and, the thermal shield extends inwardly from each opposite end of the substantially tubular ceramic member so as to define an axial gap therebetween.

In one exemplary version of the discharge lamp of the present disclosure, the substantially tubular ceramic member defining the discharge chamber has an end plug fused in each opposite end with openings provided in the end plugs for the electrodes; and, a thermal shield extends inwardly from each end plug. The end plug is fused to the substantially tubular member; and, the thermal shield may be formed integrally as one piece with the end plug or may be a separate member fused thereto.

In another exemplary embodiment, the plurality of axially spaced rings may be employed about the thermal shield to provide the radial gap with the substantially tubular ceramic member wherein the rings are fused to the thermal shield and the substantially tubular ceramic member to form a plurality of axially spaced annular chambers defining a plurality of radial spaces between the thermal shield and the substantial tubular ceramic member. In another version, the annular spaces may be formed by grooves formed in the end plug to thereby eliminate the need for separate rings to be fused to the end plug.

In another exemplary version, the region of the substantially tubular ceramic member defining the discharge chamber may have an annular bulge to provide an enlargement in the diameter of the discharge chamber in the region of the plasma where the axial gap between the thermal shields is located.

In another version, the thermal shield may comprise a plurality of individual fingers extending axially inward from the end plugs arranged to define arcuate spaces therebetween which form the radial gap between the thermal shield and the substantially tubular ceramic member.

In a further version, the arc tube may be formed in two longitudinally extending half sections each integrally formed with the opposite ends closed and a thermal shield formed integrally therewith and extending axially therefrom. Openings are integrally formed in each of the opposite ends for receiving electrodes therein. The two half arc tube sections are then fused or sintered together to form a closed discharge chamber within the arc tube assembly.

The radial gap or spaces between the thermal shield and the substantially tubular ceramic member defining the discharge chamber results in reduced heat conduction from the central portion of the plasma in the chamber towards the wall of the substantially tubular member, as well as an increased heat conduction axially to the end plugs; and both effects reduces the temperature and thermal stresses in the central portion of the substantially tubular ceramic member and decreases the axial thermal gradient in the member thereby reducing thermal stresses in general and increasing the life of the lamp.

DETAILED DESCRIPTION OF THE PREFERRED EMBODIMENTS

Figure 1:
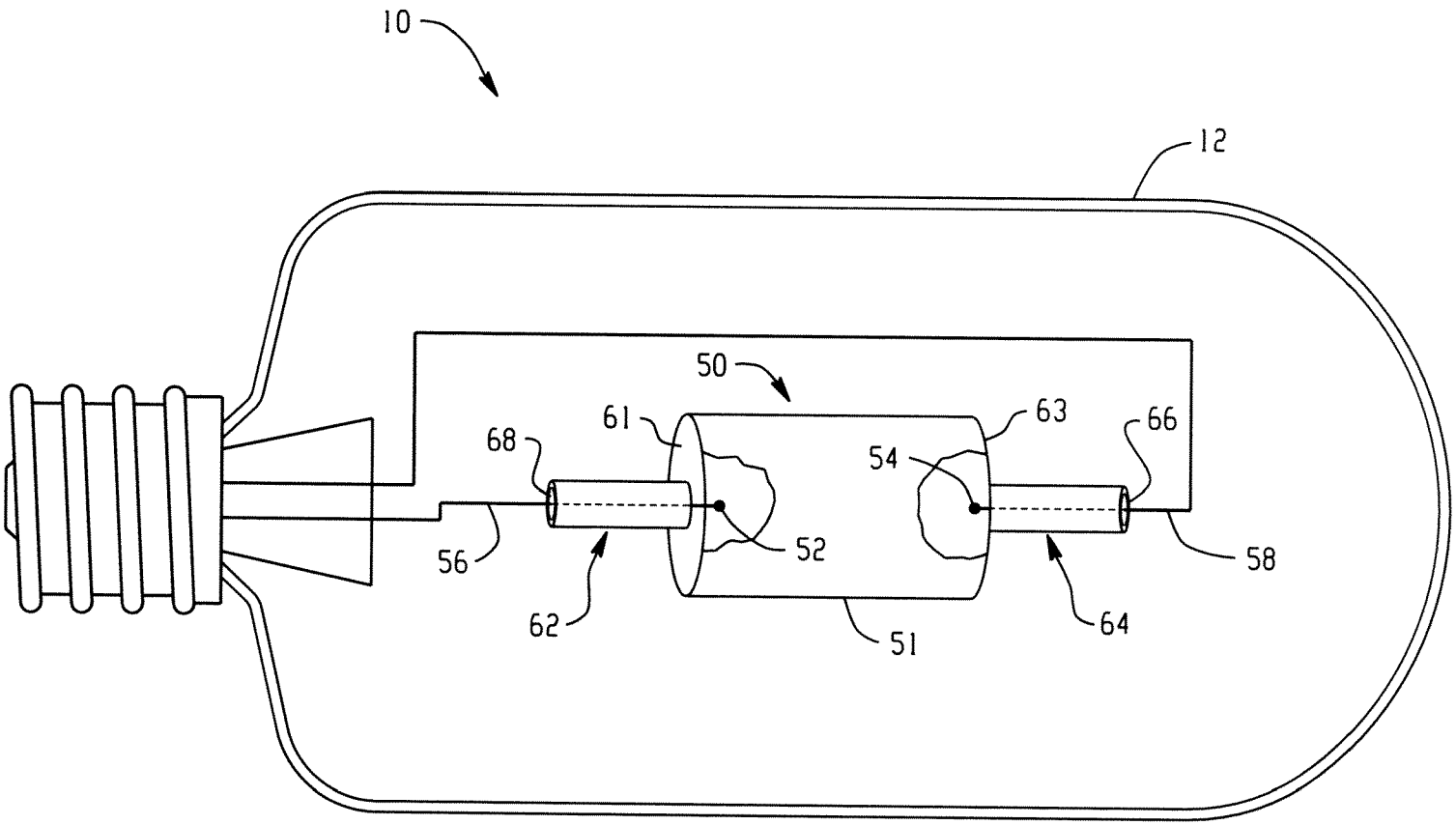
FIG. 1 illustrates a discharge lamp having a ceramic arc tube.

Referring to FIG. 1, a high intensity discharge lamp indicated generally at 10 includes an outer bulb 12 formed of translucent or transparent material and a ceramic arc tube indicated generally at 50 disposed therein having a substantially tubular member 51 at its center portion which contains two electrodes indicated generally at 52, 54 and a fill material in gaseous and partially in liquid form under operating conditions of the lamp (not shown). Electrodes 52, 54 are connected to current conductors 56, 58, which, upon connection to a source of electrical power, apply a potential difference across the electrodes. In operation, the electrodes 52, 54 generate an arc breakdown which ionizes the fill material to produce a plasma in the discharge chamber 60 of the arc tube 50. The emission characteristics of the light produced by the plasma depend primarily on the constituents of the fill material, the voltage across the electrodes, the temperature distribution of the discharge chamber, the pressure in the chamber, and the geometry of the discharge chamber and the whole arc tube assembly. For a ceramic metal halide lamp, the fill may typically comprise a mixture of Hg, a rare gas such as Argon (Ar) or Xenon (Xe) and a metal halide such as Sodium Iodide (NaI), Thallium Iodide (TlI), and Dysprosium Iodide ($DyI_3$). However, there is a clear tendency to eliminate mercury from the fill of light sources, and especially of metal halide discharge lamps and replace it with alternative buffer/voltage riser materials. For high pressure sodium lamps, the fill material typically comprises sodium, a rare gas, and Hg. Other fill materials also well known in the art may also be employed with the discharge lamp of the present disclosure.

Figure 2A:
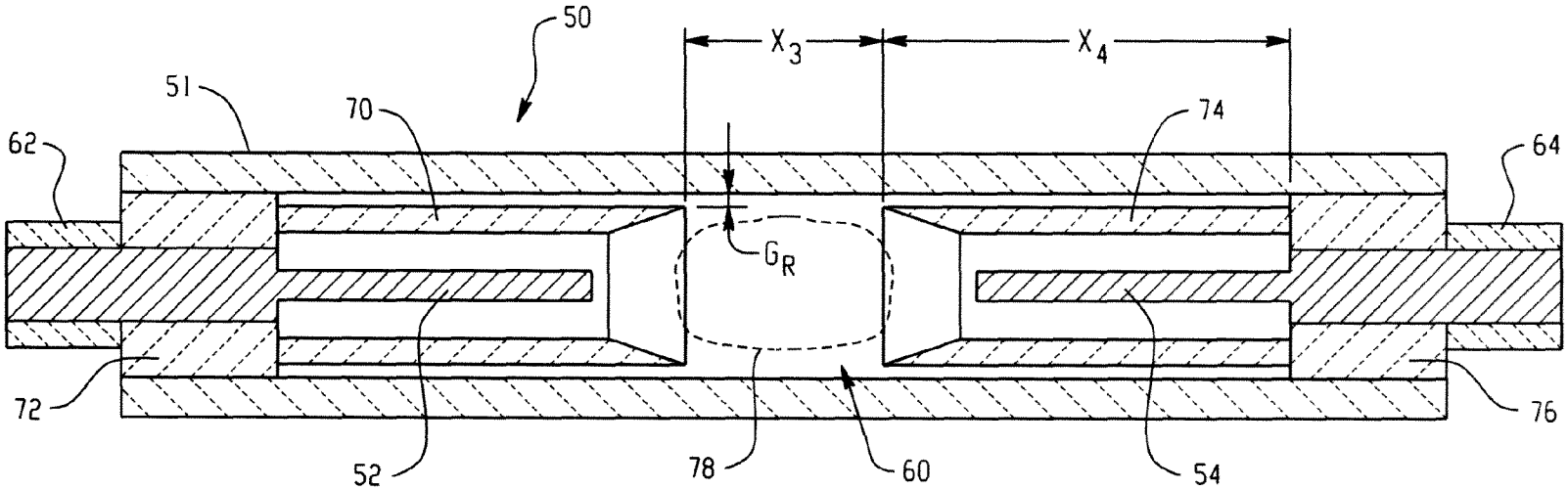
FIG. 2*a* is a cross-section of the components of FIG. 1 forming the arc tube in an exemplary version.
Figure 2B:
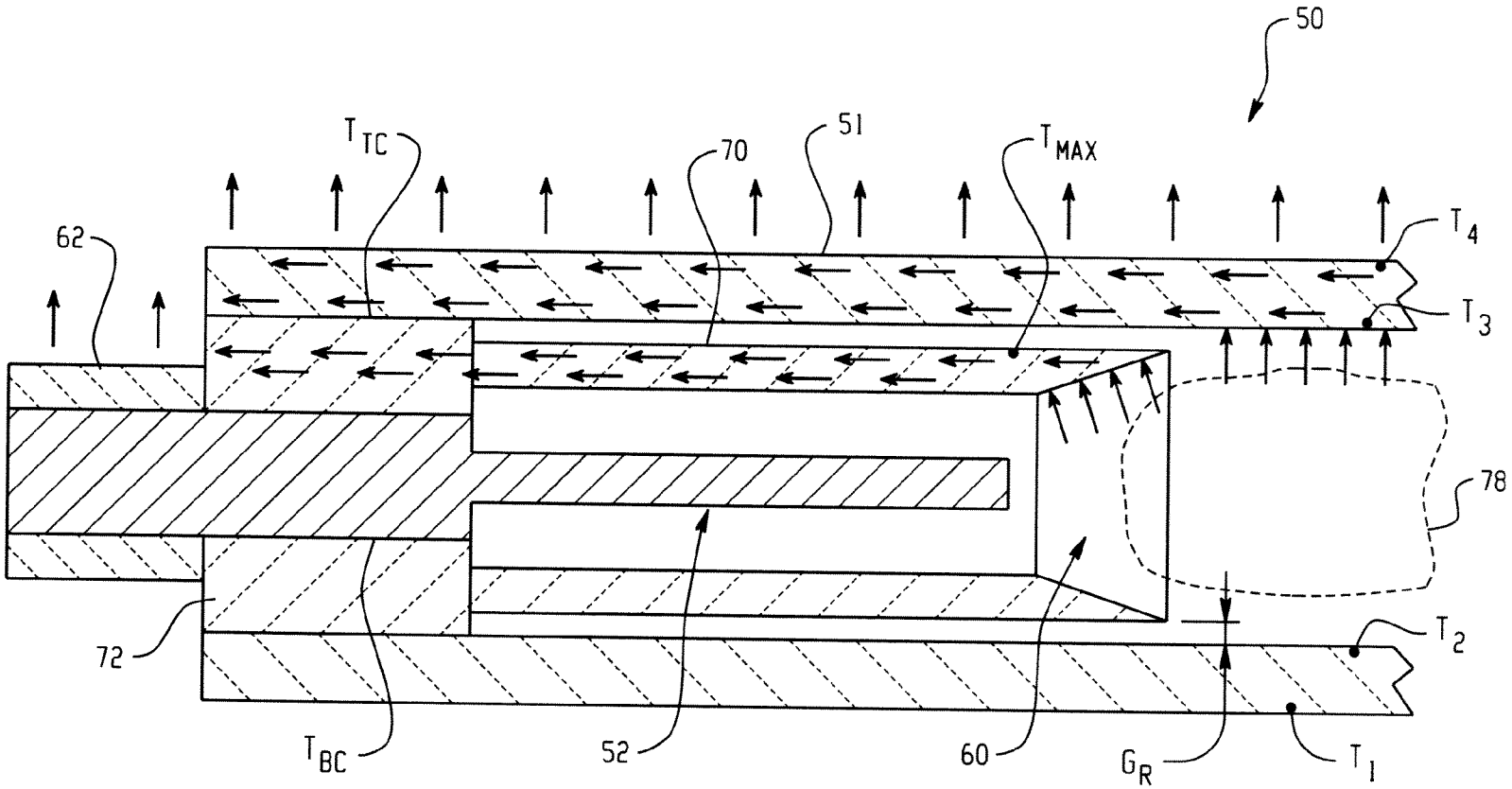
FIG. 2*b* is an enlarged portion of FIG. 2*a* illustrating the heat flow therein.

As shown in FIG. 1, the ceramic arc tube 50 for example made of Aluminum-oxide or Alumina comprises a central member 51 having a substantially tubular configuration and formed of ceramic material and embedding a discharge chamber 60 as also shown in FIGS. 2*a*, 2*b*; and, two end members 61, 63 of the substantially tubular member including outwardly extending leg portions 62, 64. The ends of the electrodes 52, 54 are typically located near the opposite ends of the substantially tubular central member 51 forming the discharge chamber 60. The electrodes 52, 54 are connected to a power supply (not shown) by the current conductors 56, 58 which are disposed within a central bore of each of the leg portions 62, 64. The electrodes are typically comprised of tungsten; and, the conductors typically comprise Molybdenum and Niobium, the Niobium having a thermal expansion coefficients close to that of Alumina to reduce thermally induced stresses on the Alumina leg portions 62, 64.

The arc tube 50 is sealed at the ends of the leg portions 62, 64 with seals 66, 68. The seals 66, 68 typically comprise a Dysprosia-Alumina-Silica glass that can be formed by placing a glass frit in the shape of a ring around one of the conductors, e.g. 56, aligning the arc tube 50 vertically and melting the frit. The melted glass then flows down into the leg 62, forming a seal between the conductor 56 and the leg 62. The arc tube 50 is then turned upside down to seal the other leg 64 after the discharge chamber 60 being filled with the fill material.

The leg portions 62, 64, extend axially away from the center of the arc tube 50. The dimensions of the leg portions 62, 64 are selected over the temperature of the seal 66, 68 by desired amount with respect to the center of the arc tube 50. The discharge chamber 60 of the arc tube 50 is embedded in a substantially tubular ceramic member 51 which is typically substantially cylindrical. For a 70 watt ceramic metal halide arc discharge lamp, the substantially tubular ceramic member 51 typically has an inner diameter of about 7 mm and an outer diameter of about 8.5 mm. For a 35 watt lamp, the member 51 typically has an inner diameter of about 5 mm and an outer diameter of about 6.5 mm. For a 150 watt lamp, ceramic member 51 typically has an inner diameter of about 9.5 mm and an outer diameter of about 11.5 mm.

Referring now to FIG. 2, the arc tube 50, in an exemplary version of the discharge lamp of the present disclosure, is shown in cross-section and has thermal shields 70, 74 extending inwardly from opposite ends of the substantially tubular or cylindrical ceramic member and that of the discharge chamber 60 which embedded and terminate centrally therein so as to have the inwardly extending ends of thermal shields 70, 74 disposed in spaced arrangement so as to define an axial gap denoted by reference character $X_3$. The thermal shields also are sized and configured so as to define thereabouts a radial gap $G_R$ with the inner periphery of the member 51. The thermal shields 70, 74 extend inwardly from end plugs 72, 76; and, the thermal shields may be formed integrally with the plugs 72, 76, respectively, or may be formed separately and attached thereto by fusion.

In the present practice, it has been found satisfactory to form the thermal shield 70, 74 and the substantially tubular ceramic member 51 defining the discharge chamber 60 of Yttrium-Aluminum-Garnet ($Y_3Al_5O_{12}$) material and has also been satisfactory to form these latter parts of one of a) Sapphire and b) Microcrystalline Alumina (MCA) material. It has further been found satisfactory to form the thermal shield 70, 74 of a) Polycrystalline Alumina (PCA) and b) Aluminum nitride material. Furthermore, it has been found particularly satisfactory to fowl the substantially tubular member 51 and thermal shield 70, 74 of one of a) translucent and b) transparent material selected from one of a) monocrystalline and b) polycrystalline material that is suitable for an arc tube of high intensity discharge (HID) lamps. However, it will be understood that other suitable ceramic materials may also be employed. It would be understood that the electrodes, end plugs and the member 51 are assembled and fused to form a containment discharge chamber 60 where the fill material which is disposed interiorly of the member 51. In operation, upon connection of an electrical potential to the electrodes 52, 54 an electric arc is discharged between the interior ends of the electrodes to form a discharge plasma illustrated in dashed outline in FIG. 2*a* and denoted by reference numeral 78. The length of the radial gap denoted by $G_R$ and formed between the thermal shield 70, 74 and the interior of member 51 is denoted by the dimension $X_4$ in FIG. 2*a*.

The axial gap $X_3$ permits emitting an optimum amount of light through the center portion of the discharge chamber 60. Definition of the axial gap $X_3$ can either be accomplished and ensured by the accuracy of the steps of the arc tube assembly process or by the help of a transparent or translucent spacer component that can either simply be a protruding portion formed on the discharge chamber wall or a separate spacer component attached to the wall.

Referring to FIG. 2*b*, the portion of the arc tube 50 of FIG. 2*a* is shown enlarged with arrows indicating the direction of flow of heat generated by the plasma 78 into the thermal shield 70, the substantially tubular ceramic member 51 and the end plug 72. The axial flow of the heat along the thermal shield reduces the temperature of the upper portion of the substantially tubular member 51 under horizontal operating conditions and increases the temperature of the end plug 72, or the plugs 72, 76 referring to FIG. 2*a*, to thereby reduce the thermal gradient along the parts and thereby reduces the thermal stress therein.

In the present practice, it has been found satisfactory to form the radial gap $G_R$ in the range of about 0.1 mm to 0.3 mm and particularly, in the range of about 0.06 mm to 0.24 mm and even more particularly in the range of about 0.03 mm to 0.12 mm. In the present practice, it has been found satisfactory to form the radial gap $G_R$ with an axial length $X_4$ in the range of about 2.0 mm to 7.5 mm and particularly, it has been found satisfactory to form the radial gap $G_R$ with the length $X_4$ in the range of about 1.0 mm to 4.0 mm; and, more particularly, it has been found satisfactory to form the radial gap $G_R$ with an axial length $X_4$ in the range of about 0.7 mm to 2.4 mm.

In the present practice, tests have shown that when the arc tube 50 is disposed in a horizontal arrangement as, for example, is the case in automotive headlamp applications, that the arc formed between the electrodes has an upwardly arched configuration (see FIG. 4) causing the upper portion of the wall of member 51 to experience higher temperatures than the lower portion.

With reference to FIGS. 2*a* and 2*b*, it will be noted that the thermal shields 70, 74 have the inwardly extending ends or arc discharge ends thereof chamfered or tapered or shaped to other optimum geometry to provide the appropriate surface configuration for an arc discharge and formation of plasma within the discharge chamber 60, as well as to avoid overheating or even melting the discharge ends of the thermal shields 70, 74.

Referring again to FIG. 2*b*, measurements and computer aided modeling results of the temperature of the inside of the upper wall of substantially tubular member 51 denoted by $T_3$ and at the outside of the wall of member 51 in the region of the arc plasma ($T_4$) were taken or calculated to compare with the temperature $T_2$ at the inside wall and $T_1$ at the outer surface of member 51 at the bottom of the region of the plasma. Temperatures readings and finite element model calculation predictions were also taken and performed at the juncture of the thermal shield with the end plug on the upper side at $T_{TC}$ and the lower side at $T_{BC}$ as denoted in FIG. 2*b*. The measurements and model calculations were taken and performed of both a typical configuration of a prior art lamp without the thermal shield and of Applicant's construction in FIG. 2*b* with the thermal shield 70, 74 and radial gap $G_R$ at the same source voltage and for the same lamp wattage.

Figure 16A:
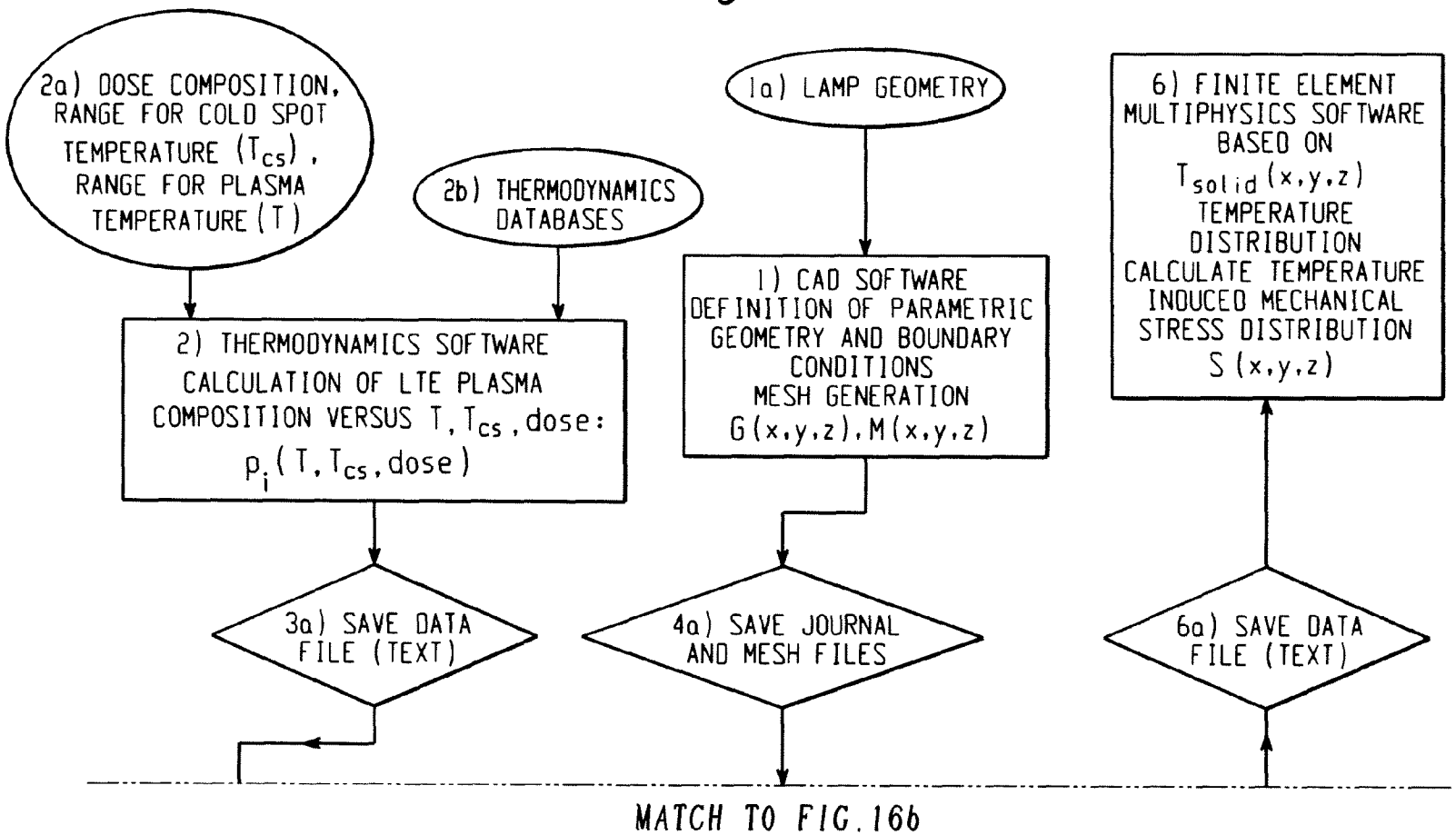
FIG. 16 is a block diagram and process flow chart of the computer modeling procedure that was used to calculate temperature and mechanical stress distribution of different exemplary versions of the discharge lamp of the present disclosure.
Figure 16B:
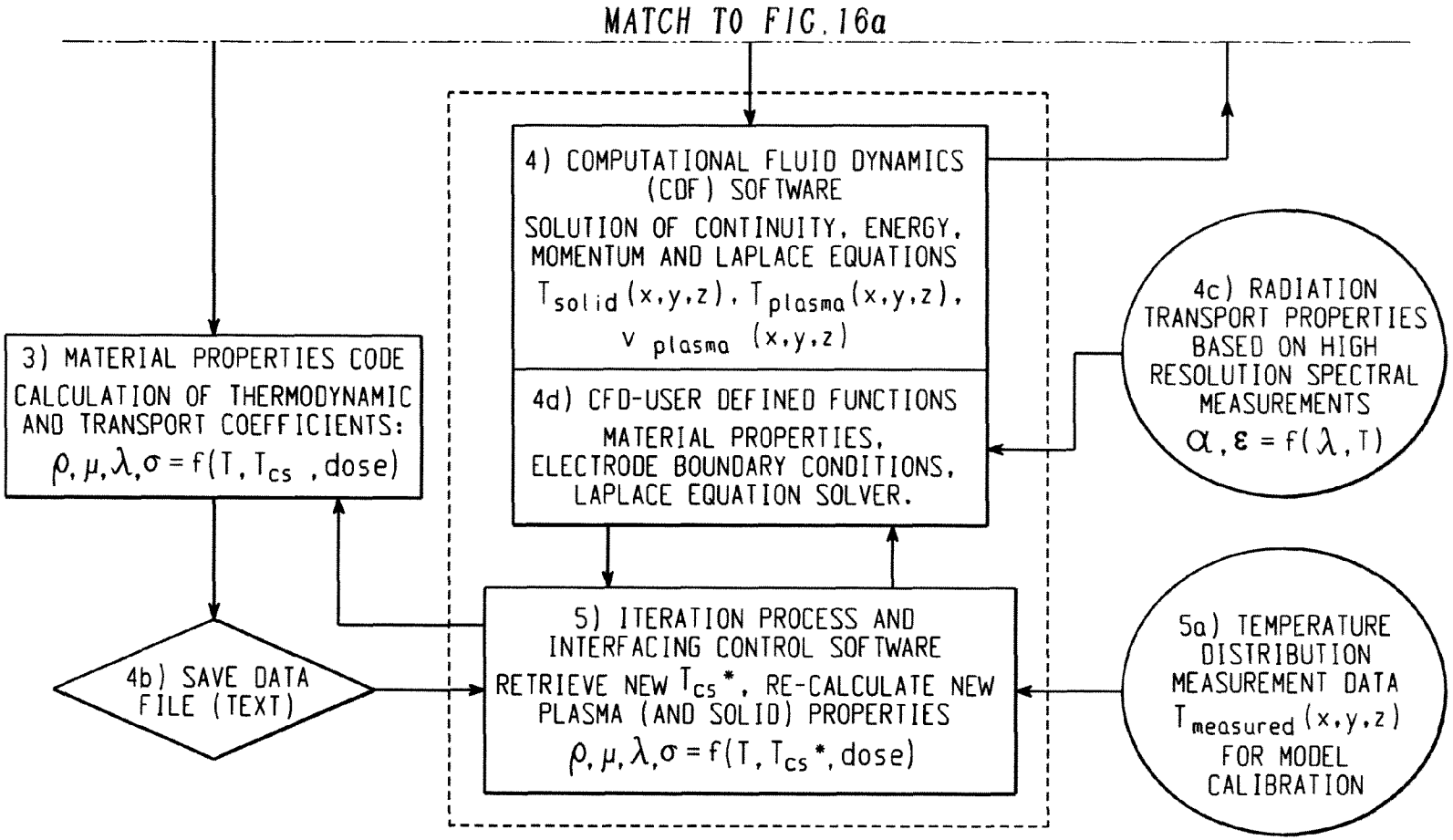

Model calculations were performed for several different arc tube construction alternatives of Applicant's construction. Referring to FIG. 16, a block diagram and process flow chart of this computer modeling procedure is shown in detail. As a first step, construction geometries (FIG. 16 Block "1*a*) Lamp geometry") of different arc tube alternatives were loaded into a "1) CAD software", and parametric arc tube model geometries with FEM (Finite Element Method) meshing were generated. (Note, that any commercial CAD software with automatic meshing feature is appropriate for this task to perform.) As another set of input data, construction details of arc chamber fill composition and boundary conditions for temperature range of liquid dose fill and arc core were provided (FIG. 16 Block "2*a*) Dose composition, . . . "). Material properties of solid-state arc tube assembly components and high temperature thermo-chemical data of liquid, vapor and gas phase fill materials in the discharge chamber can generally be obtained from public thermodynamics databases. For example, in the Applicant's case, main source of these data was the thermodynamics database of the MTDATA thermodynamics calculation and Gibbs free energy minimization software. Missing thermodynamics data were generated either internally by using interpolation and extrapolation techniques, based on the data available either from the MTDATA database itself, or from other commercially available thermodynamics databases. This thermo-chemical dataset (FIG. 16 Block "2*b*) Thermodynamics databases") served as a basis for temperature and fill composition dependent plasma composition calculations by using the MTDATA software (in general case, a "2) Thermodynamics software"), assuming LTE (Local Thermodynamic Equilibrium conditions to prevail. Plasma transport properties (electrical and thermal conductivity, gas viscosity, . . . ) were generated by an in-house made computer code, called HIDProp (FIG. 16 Block "3) Material properties code"). However, similar computer codes exist at different research institutes and companies dealing with plasma science—and especially with light source development—all over the world (see conference proceedings of ICPIG, ICOPS, LS, etc. conferences on plasma physics and light source technology). Radiation transport data were obtained from high-resolution spectral measurements (FIG. 16 Block "4*c*) Radiation transport properties").

Gas flow, heat transfer, plasma and solid-state temperature distribution, as well as electromagnetic field calculations were performed by a commercially available "4) Computational fluid dynamics (CFD) software". Local thermodynamic equilibrium (LTE) plasma conditions were assumed to be valid all over the computation process. A home made FORTRAN computer code (FIG. 16 Block "5) Iteration process and interfacing control software") served as the core of model calculations by performing the interfacing task between the different software modules (data transfer via saved text files), as well as by controlling the convergence of solutions in an iterative manner. Model calibration was performed via "5*a*) Temperature distribution measurement data". Iteration cycles stopped if model predictions fit acceptably well to these measurement results obtained on real lamp construction alternatives, or if the required convergence was achieved. Finally, thermally induced stresses in the solid-state structure of the arc tube alternatives were separately predicted by a "6) Finite element multiphysics software" (e.g. publicly available finite element code).

Some of the temperature modeling results are shown in Table I for the prior art and for two different new arc tube construction alternatives at various locations of the arc tubes and the temperature differentials there between. It is seen from Table I that substantial improvements are possible with the thermal shield of the present disclosure by either lowering the temperatures, particularly $T_3$ and $T_4$ or/and by lowering the $T_3$–$T_4$ inside-wall gradients, and the $T_4$–$T_1$ top-to-bottom temperature difference. It also has been confirmed that further optimization is possible so that all of the temperature constraints are satisfied.

TABLE I

| | | Without Thermal Shield | Thermal Shield with $G_R$ Version #1 | Thermal Shield with $G_R$ Version #1 |
|---|---|---|---|---|
| ° K | $T_1$ | 1489 | 1314 | 1357 |
| | $T_2$ | 1524 | 1321 | 1368 |
| | $T_3$ | 1742 | 1495 | 1437 |
| | $T_4$ | 1596 | 1478 | 1421 |
| | $T_{TC}$ | 1547 | 1173 | 1224 |
| | $T_{BC}$ | 1205 | 1138 | 1198 |
| | $T_{MAX}$ | n/a | 1576 | 1832 |
| | $\Delta(T_3 - T_{TC})$ | 391 | 322 | 213 |
| | $\Delta(T_3 - T_4)$ | 49 | 17 | 16 |
| | $\Delta(T_4 - T_1)$ | 58 | 164 | 64 |

It is clear from Table I that with some of these new construction alternatives it has also been shown that the thermal shield of Applicant's disclosure is beneficial not only to reduce the temperature $T_3$ and $T_4$ in the upper wall of the arc tube in the region of the plasma, but to also to conduct heat axially to the end plugs for reducing the axial temperature gradients $T_3$–$T_{TC}$ or to the bottom wall for reducing the top-to-bottom thermal gradients $T_4$–$T_1$ and temperature induced thermal stresses generated in the arc tube wall.

In the present practice, it has been found desirable to maintain $T_3$ less than 1450 Kelvin, $T_{BC}$ greater than 1200 Kelvin and to maintain $T_{MAX}$ (see FIG. 2*b*) less than 1600 Kelvin. In the present practice, it has been determined that employing values of $X_3$ (see FIG. 2*a*) near the upper limit of the described range and values of $X_4$ near the lower limit of the described range minimizes the values of $T_{MAX}$ experienced in operation. It has also been determined that employing values of $X_3$ in the lower region of the described range and values of $X_4$ in the upper region of the described range minimizes the values of $T_3$ experienced in operation. It has also been determined that maintaining values of $X_3$ in the lower region of the permitted range and values of $X_4$ in the upper region of the described range intends to maintain $T_{BC}$ near the described minimal value.

Figure 3:
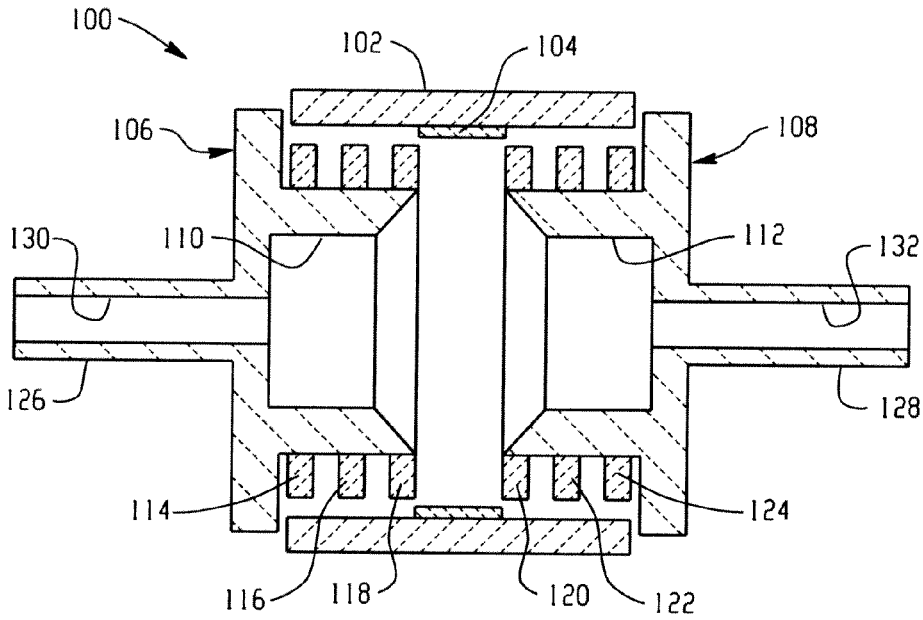
FIG. 3 is a cross-section of another exemplary version in the assembled state prior to fusing.

Referring to FIG. 3, another version of the arc tube for the discharge lamp of the present disclosure prior to its fully assembled state is indicated generally at 100 and has a substantially tubular ceramic member 102 defining the discharge chamber with the light transparent optional spacer portion 104 provided on the inner periphery thereof in the central region, with end members or plugs 106, 108 disposed on opposite ends of the member 102. The end members 106, 108 each have a thermal shield 110, 112, respectively, extending axially inwardly; and, each of the thermal shields has a plurality of axially space annular members or rings denoted 114, 116, 118, 120, 122, 124 disposed thereover in axially spaced arrangement so as to provide a plurality of annular gaps between the thermal shield and the inner periphery of the member 102. Each of the end plugs 106, 108 has, respectively, an outwardly extending leg portion 126, 128 which has a central bore 130, 132, respectively, therethrough for receiving electrodes/leads therethrough.

Figure 4:
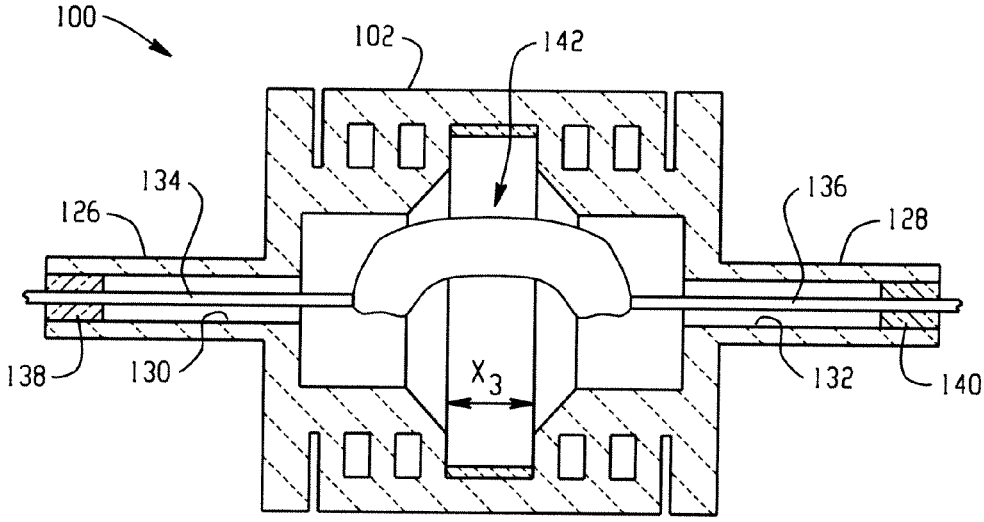
FIG. 4 is a cross-section of the version of FIG. 3 in the fused state in operation with a discharge arc therein.

Referring to FIG. 4, the parts arrangement for the version of FIG. 3 is shown fully assembled with the rings 114 through 124 fused to the inner periphery of the member 102 and the outer periphery of the thermal shields 110, 112, with a light transparent optional spacer portion 104 determining the axial gap $X_3$ between the thermal shields. The bores 130, 132 in the legs 126, 128 have, respectively, electrodes 134, 136 disposed therein and sealed by fused seal glass 138, 140. In FIG. 4, the arc tube 100 is shown in operation with an arc indicated generally at 142 formed between the electrodes 134, 136 and arched in an upwardly convex disposition as is the case for horizontal placement of the arc tube 100 in service. It will be understood that the rings 114 through 124 may be formed of the same material as the member 102 or the plugs 106, 108.

Figure 5:
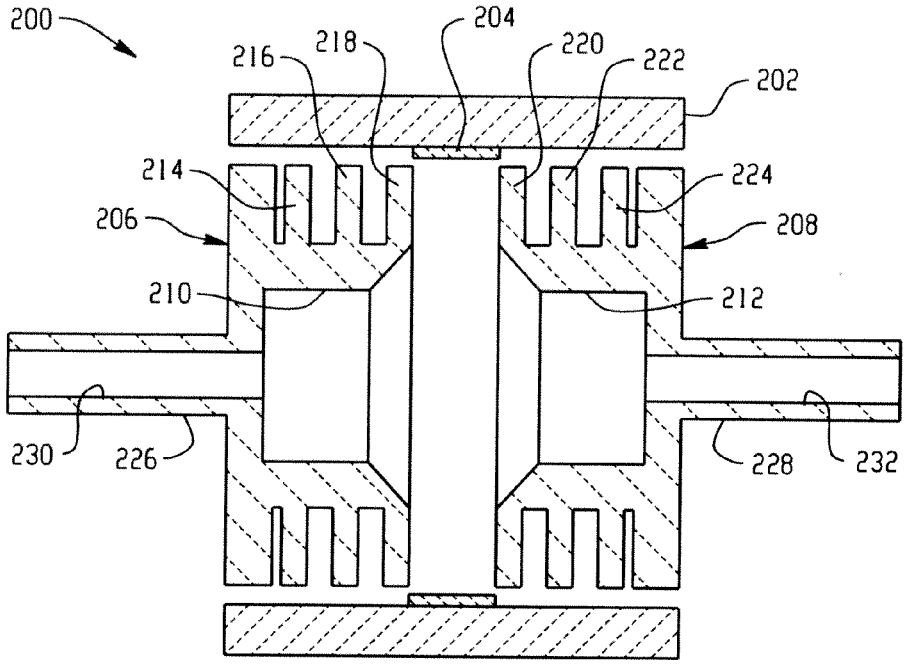
FIG. 5 is a cross-section of a further version of the arc tube of the present disclosure in the assembled state prior to fusing.

Referring to FIG. 5, another version of the arc tube of the discharge lamp of the present disclosure prior to its fully assembled state is indicated generally at 200 and includes a substantially tubular ceramic member 202 defining the discharge chamber which includes centrally disposed therein a light transparent optional spacer portion 204. A pair of end plugs indicated generally at 206, 208 are disposed at axially opposite ends of the member 202. Each of the plugs 206, 208 includes a thermal shield portion integrally formed therewith and extending axially inwardly as denoted by reference numerals 210, 212, respectively, with the outer periphery of the thermal shields 210, 212 having formed therein a plurality of axially spaced annular grooves 214, 216, 218, 220, 222, 224. Each of the end plugs 206, 208 includes an outwardly extending leg portion 226, 228, respectively, each of which has formed therein a central bore 230, 232, respectively, adapted for receiving an electrode/lead therein.

Figure 6:
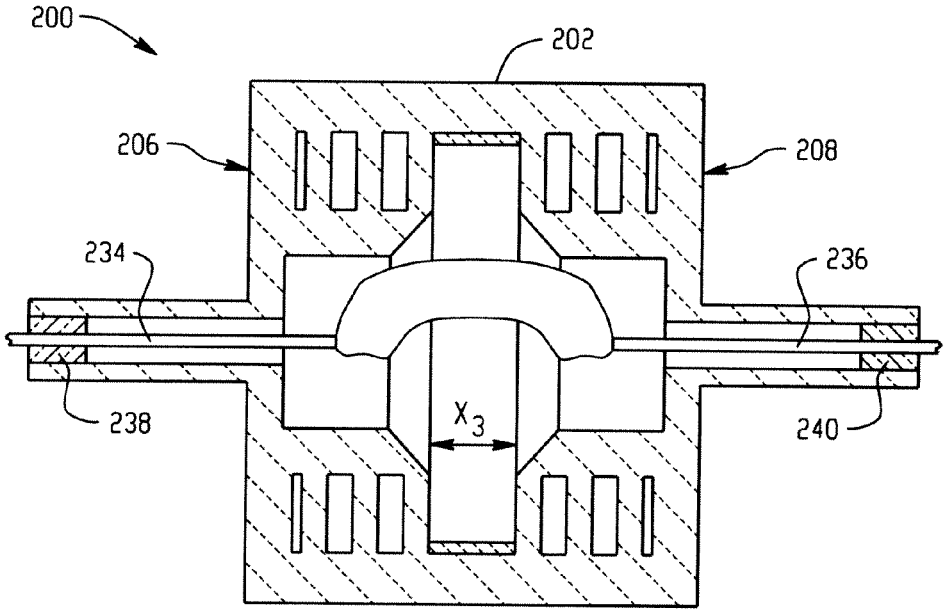
FIG. 6 is a cross-section of the arc tube of FIG. 5 in the fused condition and in operation with a discharge arc therein.

Referring to FIG. 6, the parts arrangement of the version FIG. 5 is shown in the fully assembled condition with the periphery of the plugs 206, 208 fused to the inner periphery of the member 202 in a manner forming a sealed discharge chamber. Electrodes 234, 236 are disposed, respectively, in the bores 230, 232; and, fields in the forms of fused seal glass 238, 240, respectively, are formed in the ends of the bores 230, 232 to seal electrodes 234, 236 therein. The parts arrangement of the discharge chamber of the FIG. 5 version is illustrated in FIG. 6 with the arc formed between electrodes 234, 236 and arched in an upward direction as is the case when the arc tube 200 is disposed in horizontal disposition such as may be the case in automotive headlamp applications. The axial gap between the thermal shields is denoted by reference character $X_3$ in FIG. 6.

Figure 7:
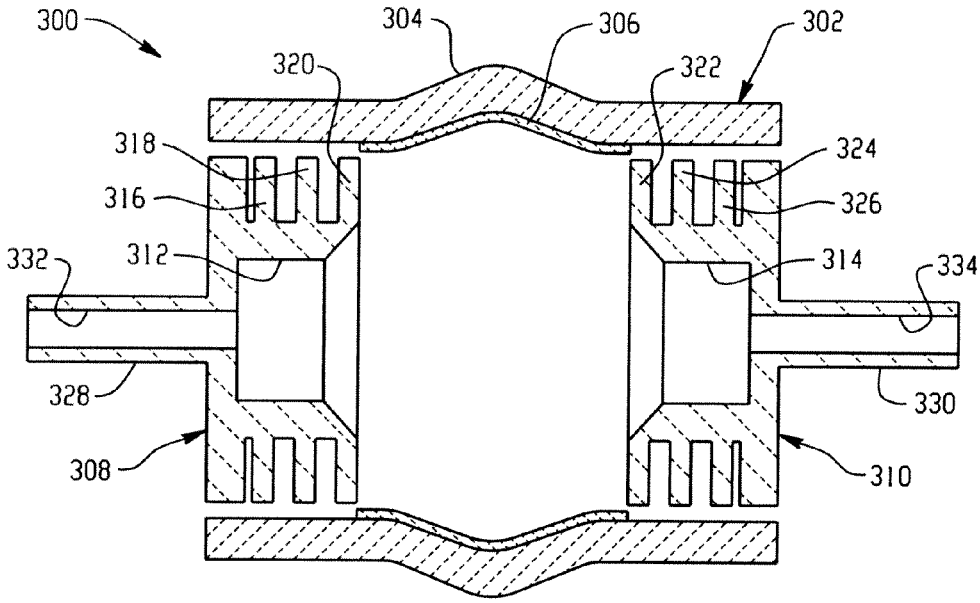
FIG. 7 is a cross-section of another version of the arc tube of the present disclosure embodying the bulged or convoluted tubular discharge chamber with the components shown in the assembled state prior to fusing.

Referring to FIG. 7, another version of the arc tube of the discharge lamp of the present disclosure prior to its fully assembled state is indicated generally at 300 and includes a substantially tubular ceramic member indicated generally at 302 defining the discharge chamber and which includes a light transparent optional spacer portion member 304 conformed to fit the inner periphery of the convolution in the central region of the member 302 as denoted by reference numeral 306. A pair of end plugs indicated generally at 308, 310 are disposed in axial opposite ends of the member 302; and, each of the end plugs includes a thermal shield portion 312, 314, respectively, extending axially inwardly thereof. The thermal shields 312, 314 each have a plurality of circumferentially extending axially spaced grooves 316, 318, 320, 322, 324, 326, respectively, formed therein for providing axially disposed radial gaps between the thermal shields and the member 302. Each of the end plugs 308, 310 also has a leg portion 328, 330, respectively, formed integrally therewith and extending axially outwardly therefrom with each of the legs having, respectively, a central bore 332, 334 formed therein for receiving an electrode/lead therein.

Figure 8:
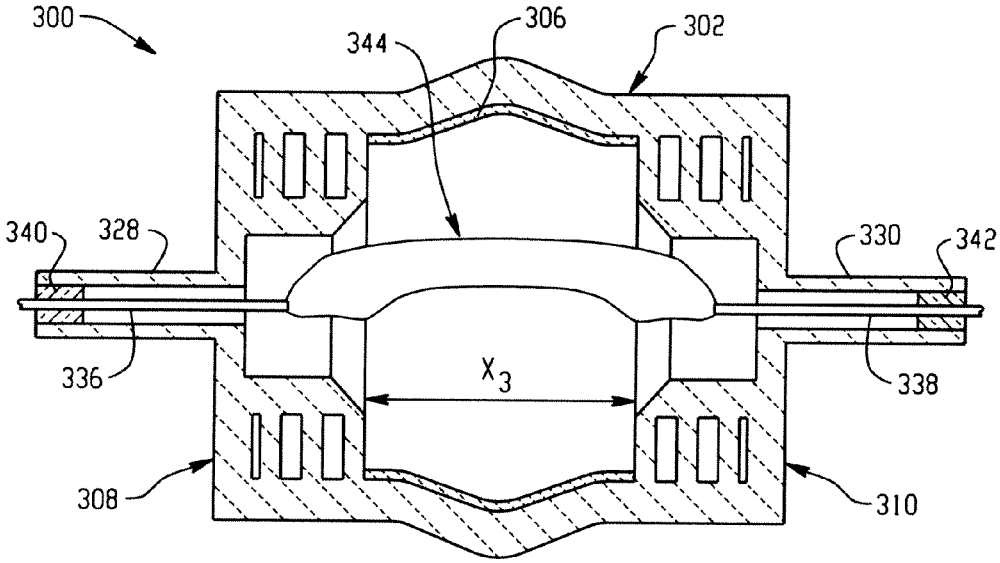
FIG. 8 is a cross-section of the version of FIG. 7 in the fused condition and in operation with a discharge arc therein.

Referring to FIG. 8, the parts arrangement of FIG. 7 is shown in the final assembled condition with the end plugs 308, 310 fused to the member 302 and sealed therein to provide a plurality of axially spaced radial air gaps formed by the grooves 316 through 326. The axial gap between the thermal shields is denoted by the reference character $X_3$. A pair of electrodes 336, 338 are disposed respectively and the bores 332, 334 and sealed therein by fused seal glass 340, 342 respectively. Where the arc tube 300 is placed in service in a horizontally disposed arrangement as shown in FIG. 8, the arc discharged between electrodes 336, 338 assumes an upwardly arched configuration as illustrated in FIG. 8 and indicated generally by reference numeral 344.

Figure 9:
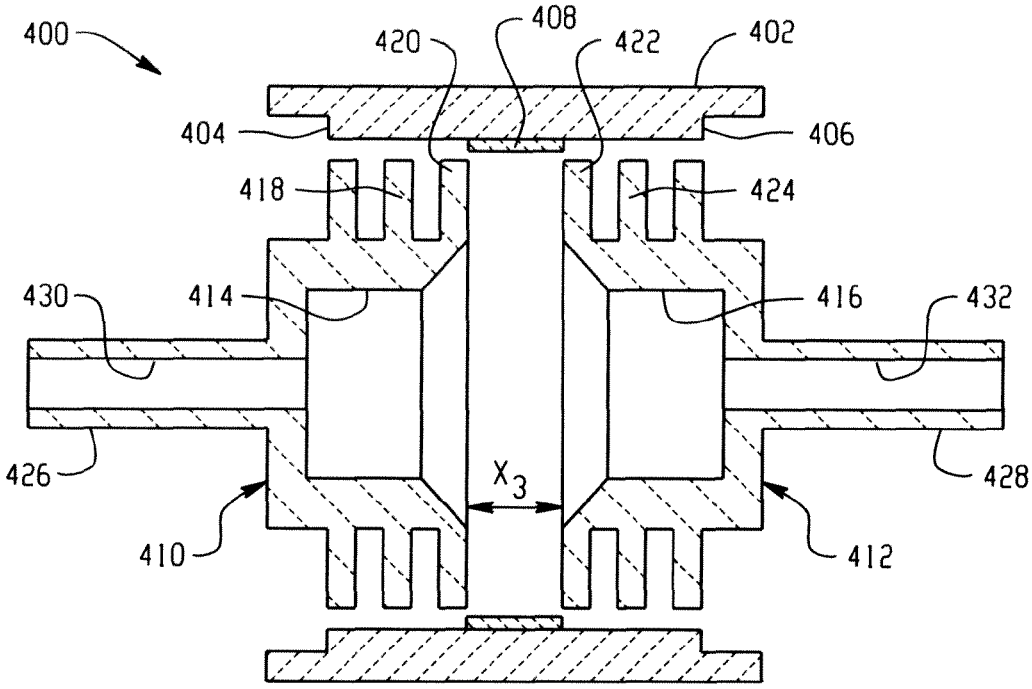
FIG. 9 is a cross-section of another version of the arc tube of the present disclosure with the parts disposed in assembled condition prior to fusing.

Referring to FIG. 9, another version of the arc tube for a discharge lamp of the present disclosure prior to its fully assembled state is indicated generally at 400 and includes a substantially tubular ceramic member 402 defining the discharge chamber which has a shoulder or counterbore formed in each end thereof as denoted respectively by reference numerals 404, 406. A centrally disposed light transparent optional spacer portion 408 is disposed about the inner periphery of member 402. A pair of end plugs indicated generally at 410, 412 each have a thermal shield 414, 416 respectively extending axially inwardly therefrom with a plurality of axially spaced peripheral grooves 418, 420, 422, 424 formed about the outer periphery thereof. Each of the end plugs 410, 412 has an outwardly extending leg portion 426, 428 respectively fanned integrally therewith, the leg portions each having a central bore 430, 432, respectively, formed therein for receiving an electrode/lead. The end plugs are disposed in the member 402 so as to be axially coincident with the shoulders 404, 406, respectively, thereby resulting in the member 402 extending axially outwardly of the end plugs 410, 412. Although not shown in FIG. 9, the end plugs are subsequently fused in place with the member 402 in the positions indicated in FIG. 9.

Figure 10:
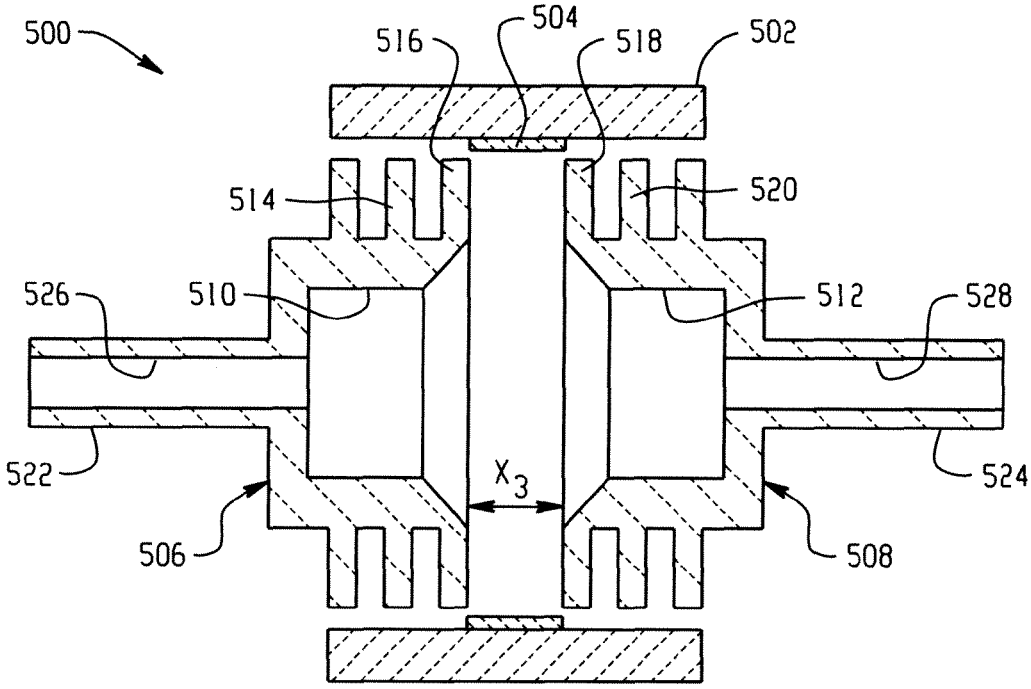
FIG. 10 is a cross-section of another version of the arc tube of the present disclosure with the parts disposed in assembled condition prior to fusing.

Retelling to FIG. 10, another version of the arc tube for a discharge lamp of the present disclosure prior to its fully assembled state is indicated generally at 500 and includes a substantially tubular ceramic member 502 defining a discharge chamber and which has a centrally disposed light transparent optional spacer portion 504 disposed about the inner periphery thereof. A pair of end plugs denoted generally at 506, 508 are disposed in the opposite ends of member 502 with each of the end plugs having respectively provided thereon and integrally formed therewith an axially inwardly extending thermal shield respectively 510, 512 which has a plurality of axially spaced peripherally extending grooves 514, 516, 518, 520 respectively formed therein so as to provide axially spaced radial gaps between the thermal shield and the member 502. Each of the end plugs 506, 508 also has a leg portion 522, 524, respectively, extending axially outwardly therefrom with each of the leg portions having a central bore therethrough denoted respectively 526, 528. In the arrangement of FIG. 10, the end plugs extend into the member 502 so as to be axially coincident or flush with the ends thereof when fused together at final assembly.

Figure 11:
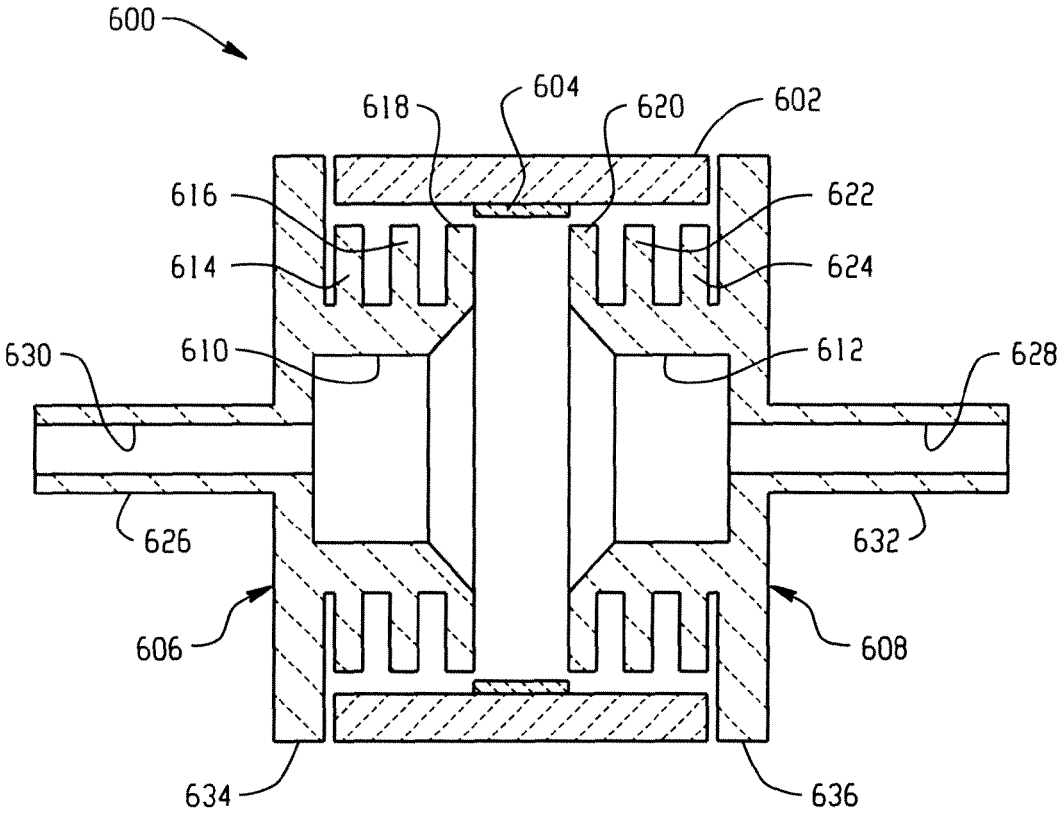
FIG. 11 is a cross-section of another version of the arc tube of the present disclosure with the parts disposed in assembled condition prior to fusing.

Referring to FIG. 11, another version of an arc tube for a discharge lamp in accordance with the present disclosure prior to its fully assembled state is indicated generally at 600. The version 600 includes a substantially tubular ceramic member 602 for defining a discharge chamber and which has a centrally axially centrally disposed a light transparent optional spacer portion disposed about the inner periphery thereof as denoted by reference numeral 604. The arc tube 600 also includes a pair of end plugs indicated generally at 606, 608, each having a thermal shield portion formed integrally therewith and extending axially inwardly as denoted respectively at 610, 612; and, each of the thermal shields 610, 612 has provided on the outer periphery thereof a plurality of spaced peripheral radially extending grooves 614, 616, 618, 620, 622, 624, 626 for providing radial spaces or gaps between the thermal shields and the inner periphery of member 602. Each of the end plugs 606, 608 has respectively extending axially outwardly therefrom a leg portion denoted 626, 268 each of which has a central bore 630, 632 formed therein adapted for receiving an electrode/lead therein. Although not shown in FIG. 11, it will be understood that the parts are fused together in the position indicated such that the end plugs are sealed in the member 602 to provide a discharge chamber; and, the end plugs 606, 608 include radially extending end flanges 634, 636 respectively, which extend radially outwardly over the ends of the member 602 and are fused thereto.

Figure 13:
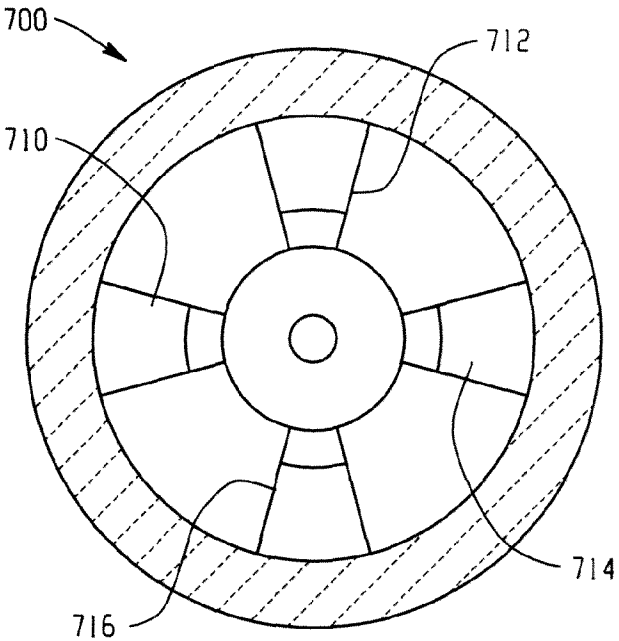
FIG. 13 is a cross-section of the version of FIG. 12 taken along dashed indicating lines 13-13; and, FIG. 14 is a perspective view of another version of the arc tube of the present disclosure having the arc tube and its substantially tubular ceramic member defining the discharge chamber formed in two halves preassembled with the thermal shields extending inwardly from opposite ends thereof and subsequently the two halves fused together.
Figure 12:
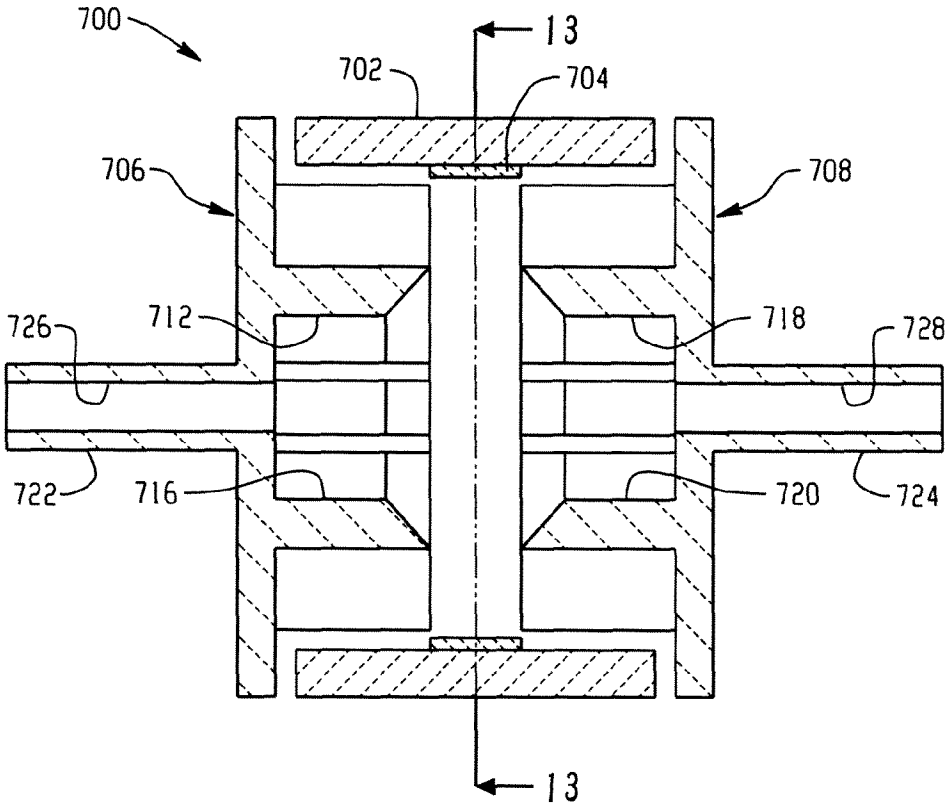
FIG. 12 is a cross-section of another version of the arc tube of the present disclosure having the thermal shield formed by a plurality of axially inwardly extending projections from the end plug.

Referring to FIGS. 12 and 13, another version of the arc tube for a discharge lamp is indicated generally at 700 and includes a substantially tubular ceramic member 702 defining the discharge chamber with a centrally disposed circumferential light transparent optional spacer portion provide about the inner periphery thereof as denoted by reference numeral 704. A pair of end plugs indicated generally at 706, 708 are disposed on opposite axial ends of the member 702. Each of the end plugs 706, 708 includes a plurality of axially extending circumferentially spaced rods forming thermal shields as denoted by reference numerals 710, 712, 714, 716 in FIG. 13 for the end plug 706; and, in FIG. 12, two of the rods for plug 708 are indicated and denoted by reference numerals 718, 720. In the present practice, the rods 710 through 720 are formed integrally with the end plugs 706, 708. The circumferential spaces between the rods thus provide a radial gap between the thermal shield and the inner periphery member 702. It will be understood that although the components shown arranged in FIG. 12 are not in the final assembled condition, that this is accomplished by fusing the end plugs to the axially opposite ends of the member 702 and the outer periphery of the rods to the inner periphery of member 702. Each of the end plugs 706, 708 has respectively formed thereon a leg portion 722, 724, respectively, each of which has a central bore 726, 728, respectively, therethrough for receiving an electrode/lead therein.

Figure 14:
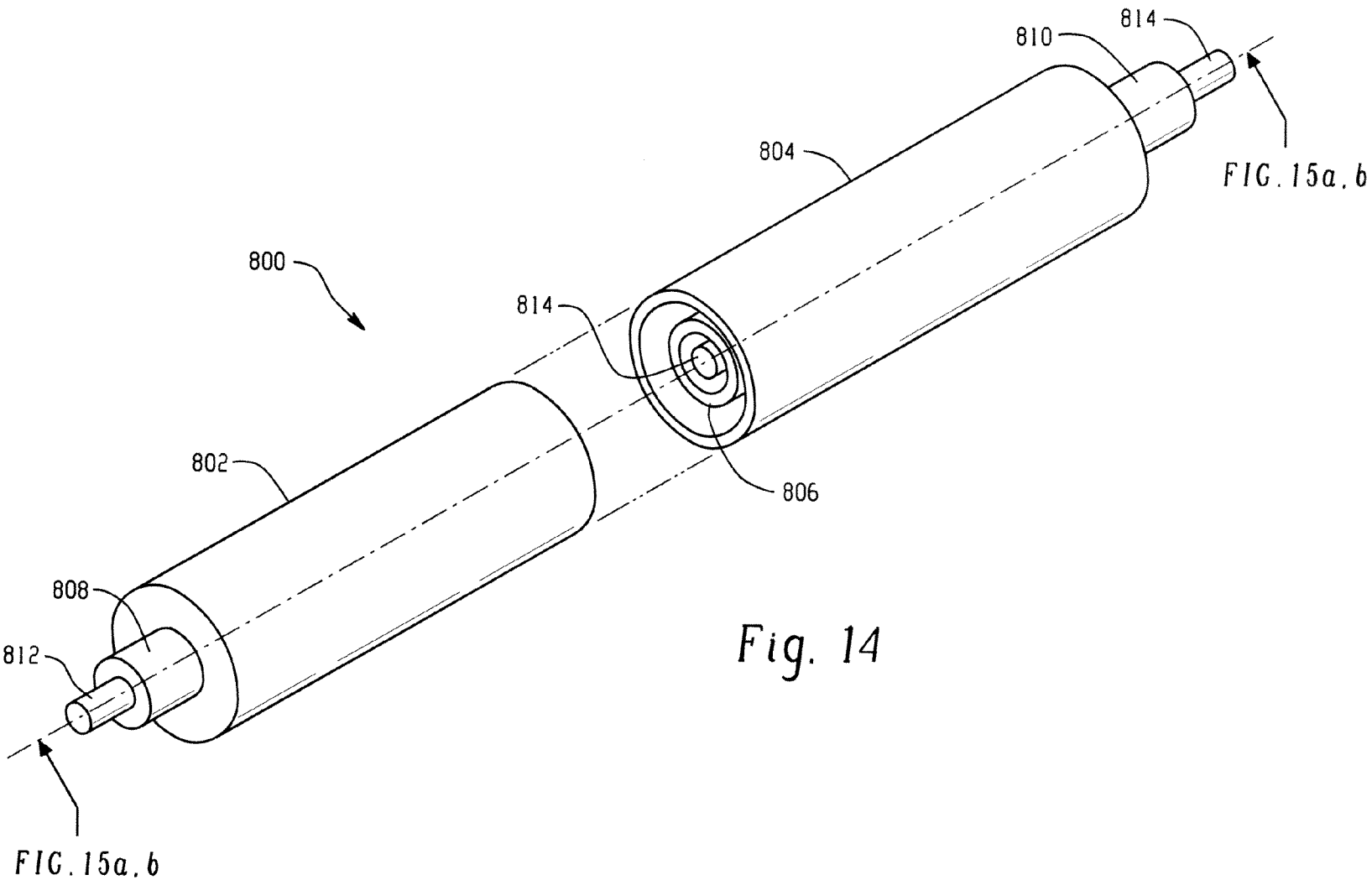

Referring to FIG. 14, another version of the arc tube for a discharge lamp prior to its fully assembled state is indicated generally at 800 and has a pair of substantially tubular ceramic member half-sections for forming a half arc tube portion indicated at 802, 804 and which are symmetric, each having disposed therein a thermal shield such as 806 shown for the half section 804 which thermal shield defines a radial gap thereabout with the inner periphery of the member 804. Each of the half sections 802, 804 also has a leg portion denoted respectively 808, 810 extending axially outwardly from the end thereof and which leg portion has received and sealed therein, such as by using a fused seal glass, an electrode 812, 814 which extends axially inwardly to the region adjacent the end of the thermal shield 806. Thus, the arc tube 800 is formed in two half arc tube portions with half section members 802, 804 which are then joined together at their inwardly extending ends and fused as indicated by the dashed lines in FIG. 14.

Figure 15A:
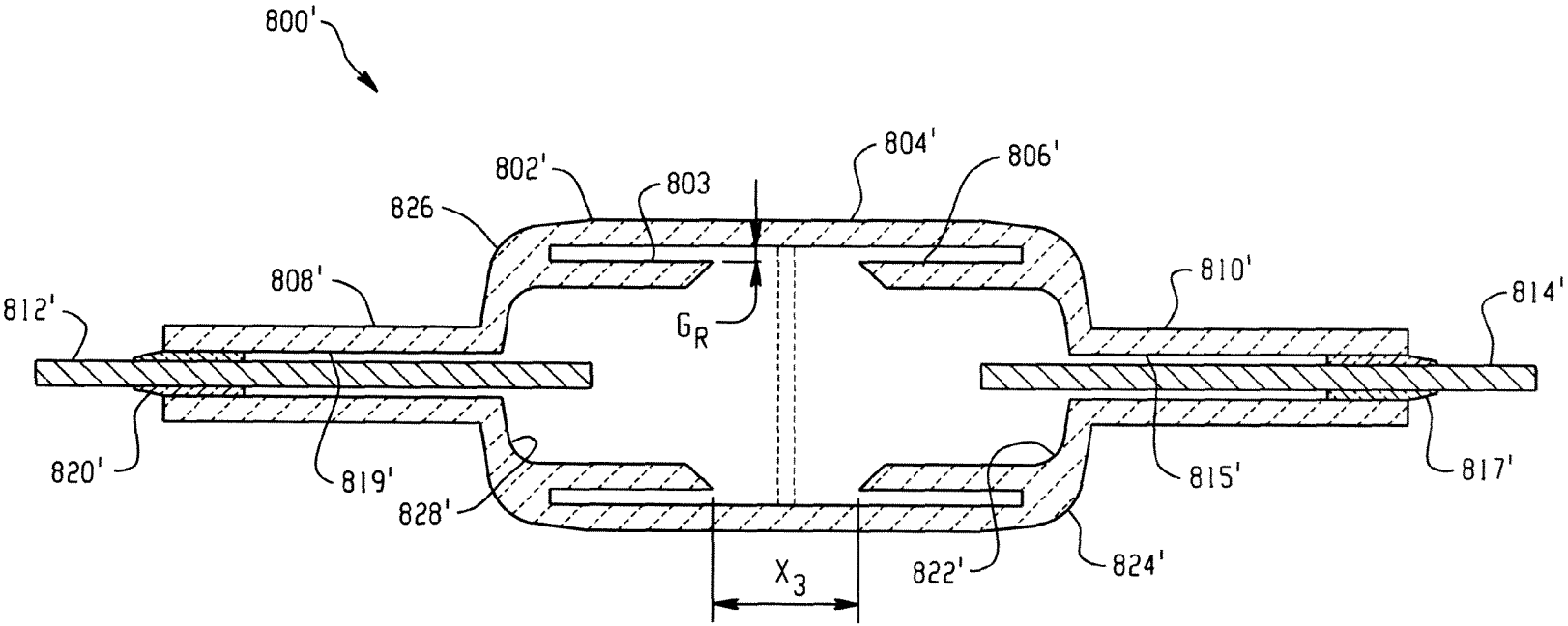
FIG. 15*a* is a sectional view taken along section-indicating line 15*a* of FIG. 14 with the additional feature of substantially hemispherically shaped or curved surface end plug geometry; and, FIG. 15*b* is a sectional view taken along section-indicating line 15*b* of FIG. 14.

Referring to FIG. 15*a*, a variation of the version 800 of FIG. 14 is shown wherein the arc tube is indicated generally at 800' and is shown in the fully assembled or fused condition with the half sections 802', 804' joined at their open ends as indicated by the dashed line. Half section 804' has integrally formed therewith such as by molding the thermal shield 806'; and, half section 802' has formed integrally therewith such as by molding a similar thermal shield 803'. The closed end of arc tube 804' has formed integrally therewith, such as by molding, and extending axially outwardly therefrom a leg portion 810' into which is received an electrode 814' which is fused into the opening 815' formed in the leg 814' by suitable ceramic material as indicated at 817'. Electrode 814' has its inward end extending into the discharge chamber so as to be positioned therein for forming the lighting arc discharge to a respectively oppositely disposed electrode. Similarly, arc tube 802' has a leg portion 808' extending axially outwardly therefrom with a central opening 819' formed therein into which is received electrode 812' which is fused by suitable ceramic material denoted by 820'; and, the inwardly extending end of electrode 812' is positioned similarly to provide for arc discharge with the electrode 814'.

It will be seen that in the embodiment 800' of FIG. 15 *a*, the juncture of the arc tube with the closed end for the half section 804' is formed with internally radiused corner 822' and an external radiused corner 824'. Similarly, arc tube half section 802' is formed with an externally radiused corner 826' and internally radiused corner 828' which facilitates arc tube forming as, for example, by injection molding of the ceramic material prior to sintering.

Figure 15B:
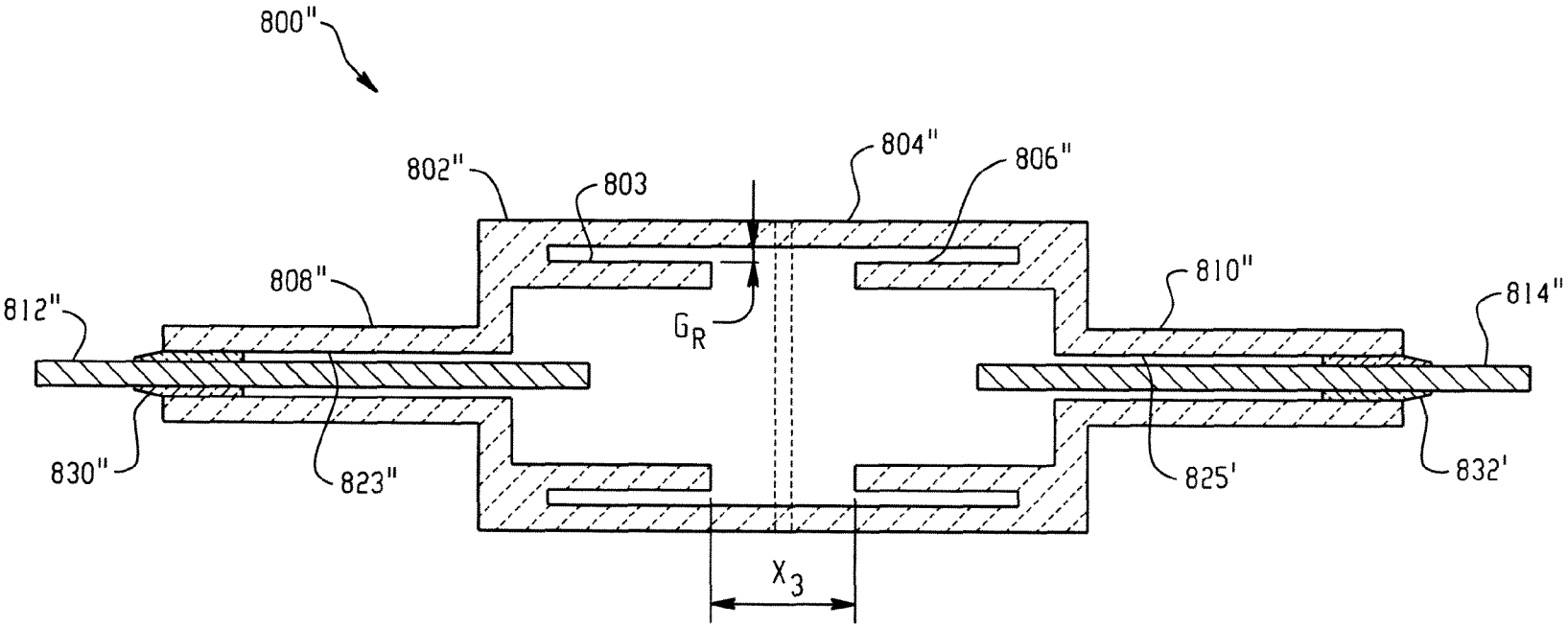

Referring to FIG. 15*b*, another variation of the embodiment 800 of FIG. 14 is indicated generally at 800" and includes a substantially tubular ceramic member half section 802" and 804". The half sections are formed integrally with a closed end and axially inwardly extending thermal shield 803" and 806" and with outwardly extending leg portions 808" and 810". The leg portions each have, respectively, a central opening 823", 825". Electrodes 812" and 814" are disposed respectively in the leg portions 808', 810' and fused therein with suitable ceramic fusing material or seal glass 830", 832", respectively. In the present practice, it has been found satisfactory to form the half sections 802", 804" in the embodiment 800" integrally as a single piece prior to sintering. However, it will be understood that, alternatively, the thermal shields 803" and 806" may be formed as separate pieces and sealed into the exposed end of the discharge chambers prior to sintering.

The present disclosure thus describes an improved arc tube design for a discharge lamp which has a thermal shield provided internally in the discharge chamber of the arc tube and defining a radial gap therebetween for lowering the temperature of the arc tube wall in the region of the discharge plasma and for conducting heat axially to the closed ends of the arc tube, and more preferably to the end portions of the discharge chamber, in most cases also known generally as end plugs. Various versions are described for providing thermal shields on end plugs which are fused to the substantially cylindrical central portion of the arc tube to constitute the end portions of the discharge chamber, and for providing the radial gap between the thermal shields extending inwardly from the end plugs. The thermal shields may be fused as a separate member to the end plugs or formed integrally therewith; and, the end plugs each have outwardly extending leg portions provided thereon for having electrodes fused and sealed therein. These leg portions are common features of the contemporary ceramic metal halide arc discharge lamps, and required for placing the electrode lead-trough seal portions of the arc tube to lower temperature location, thus reducing the chemical reaction rate between the chemically aggressive metal halide dose and the seal frit. In High Pressure Sodium lamps, no such leg portions are used. As technology advancement continues, ceramic metal halide arc discharge lamps without the leg portion may also become possible. Other versions of the disclosure employ an arc tube formed in half-sections, each half-section formed integrally into a closed end, and including a thermal shield and an external leg portion receiving an electrode therein which half-sections are then fused or sintered together to form an arc tube embedding a discharge chamber at its center portion. The arc tube arrangement of the present disclosure thus provides reduced radial thermal conduction from the discharge plasma towards the wall of central portion of the discharge chamber, as well as increased axial thermal conduction from the center of the discharge chamber embedded in the arc tube towards its end portions to reduce maximum temperature values of the arc tube wall, and thermal gradients axially, circumferentially and inside the arc tube wall thereby reducing the thermally induced mechanical stresses therein.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A high intensity discharge lamp having a discharge arc tube comprising:

(a) a substantially tubular ceramic member defining a discharge chamber intermediate opposite ends thereof;

(b) an end plug having an opening therein for receiving an electrode/lead, wherein an end plug is disposed in each opposite end of the substantially tubular ceramic member;

(c) a thermal shield extending from each end plug inwardly of the discharge chamber and defining a radial gap with the substantially tubular ceramic member; and, (d) an electrode/lead received in each end plug and having an end extending into the discharge chamber to define an arc gap therebetween, wherein the thermal shields extend inwardly from each end plug beyond the end of the respective electrode to define an axial gap therebetween significantly less than the arc gap wherein the thermal shields are operative during arc discharge to radially shield portions of the substantially tubular ceramic member from arc heat and to conduct heat axially to the end plugs.

2. The lamp defined in claim 1, wherein the thermal shield is formed integrally as one-piece with the end plug.

3. The lamp defined in claim 1, wherein the thermal shield has the inwardly extending end thereof configured as one of tapered and shaped axially.

4. The lamp defined in claim 1, wherein the thermal shield extending from one end plug defines an axial gap with the thermal shield extending from the opposite end plug.

5. The lamp defined in claim 1, further comprising a seal between the end plug and the thermal shield and between thermal shield and the substantially tubular ceramic member.

6. The lamp defined in claim 1, wherein the radial gap is in the range of about 0.1 mm to 0.3 mm.

7. The lamp defined in claim 1, wherein the radial gap is in the range of about 0.06 mm to 0.24 mm.

8. The lamp defined in claim 1, wherein the radial gap is in the range of about 0.03 mm to 0.12 mm.

9. The lamp defined in claim 1, wherein the radial gap has an axial length in the range of about 2.0 mm to 7.5 mm.

10. The lamp defined in claim 1, wherein the radial gap has an axial length in the range of about 1.0 mm to 4.0 mm.

11. The lamp defined in claim 1, wherein the radial gap has an axial length in the range of about 0.7 mm to 2.4 mm.

12. The lamp defined in claim 1, wherein the thermal shield has a relatively thin walled substantially tubular configuration.

13. The lamp defined in claim 1, wherein the substantially tubular member defining the discharge chamber and the thermal shield are formed of one of (a) transparent and (b) translucent ceramic material.

14. The lamp defined in claim 1, wherein at least the substantially tubular member defining the discharge chamber and the thermal shield are formed of Yttrium Aluminum Garnet ($Y_3Al_5O_{12}$) material.

15. The lamp defined in claim 1, wherein at least the substantially tubular member defining the discharge chamber and the thermal shield are formed of one of (a) sapphire, (b) polycrystalline alumina (PCA) and c) microcrystalline alumina (MCA) material.

16. The lamp defined in claim 1, wherein at least the substantially tubular member and the thermal shield are formed of aluminum nitride (AIN) material.

17. The lamp defined in claim 1, wherein at least the substantially tubular member and the thermal shield are formed of one of (a) translucent and (b) transparent material selected from one of (a) monocrystalline and (b) polycrystalline material that is suitable for a discharge arc tube of a high intensity discharge (HID) lamp.

18. The lamp defined in claim 1, wherein the end plug has a plurality of axially spaced circumferential grooves formed therein.

19. The lamp defined in claim 1, wherein the thermal barrier includes a plurality of circumferentially spaced axially extending members.

20. The lamp defined in claim 1, wherein the thermal shield has a non-circular cross-section.

21. The lamp defined in claim 1, wherein the thermal shield has a circular cross-section.

22. A high intensity discharge lamp having a discharge tube comprising:

(a) a substantially tubular ceramic member defining a discharge chamber intermediate opposite ends thereof;

(b) each opposite end of the substantially tubular ceramic member having an opening therein for receiving an electrode/lead;

(c) a thermal shield extending from each opposite end of the substantially tubular ceramic member inwardly of the discharge chamber and defining a radial gap with the substantially tubular ceramic member; and, (d) an electrode/lead received in each of the opposite end openings and extending into the discharge chamber defining an arc gap therebetween, wherein the thermal shields extending from each opposite end of the substantially tubular ceramic member define an axial gap significantly less than the arc gap therebetween.

23. A high intensity discharge lamp having a discharge arc tube comprising:

(a) a substantially tubular ceramic member defining a discharge chamber intermediate opposite ends thereof;

(b) each opposite end of the substantially tubular ceramic member having an opening therein receiving an electrode/lead;

(c) a thermal shield extending from each opposite end of the substantially tubular ceramic member inwardly of the discharge chamber and defining a radial gap with the substantially tubular ceramic member; and, (d) an electrode/lead received in each of the opposite end openings and extending into the discharge chamber, wherein the thermal shields extending from each opposite end of the substantially tubular ceramic member extend inwardly beyond the respective electrode/lead and define an axial air gap therebetween, wherein the thermal shields are operative during arc discharge to radially shield positions of the substantially tubular ceramic member intermediate the opposite ends from arc heat and to conduct heat axially to the region of the respective opposite end of the substantially tubular ceramic member.

* * * * *